US006724302B2

(12) United States Patent
Parsadayan

(10) Patent No.: US 6,724,302 B2
(45) Date of Patent: Apr. 20, 2004

(54) METHOD AND APPARATUS FOR THE SAFE MANUAL OPERATION OF AN AUTOMATED SECURITY GATE

(75) Inventor: Walter Parsadayan, Lake Forest, CA (US)

(73) Assignee: Link Door Controls, Inc., Elmhurst, IL (US)

( * ) Notice: Subject to any disclaimer, the term of this patent is extended or adjusted under 35 U.S.C. 154(b) by 0 days.

(21) Appl. No.: 10/092,845

(22) Filed: Mar. 6, 2002

(65) Prior Publication Data

US 2003/0169166 A1 Sep. 11, 2003

(51) Int. Cl.[7] ..... G08B 23/00

(52) U.S. Cl. ..... 340/500; 340/507; 340/532; 340/552; 340/5.7; 49/25; 49/31; 49/139; 49/279

(58) Field of Search ..... 340/500, 507, 340/532, 545.1, 545.2, 545.3, 545.7, 550, 552, 555, 556, 693.1, 5.1, 5.7; 49/25, 27, 28, 31, 87.1, 139, 140, 141, 279, 280

(56) References Cited

U.S. PATENT DOCUMENTS

| | | | | | |
|---|---|---|---|---|---|
| 4,549,369 | A | * | 10/1985 | Foley, Jr. | 49/279 |
| 4,887,205 | A | * | 12/1989 | Chou | 700/90 |
| 6,092,338 | A | * | 7/2000 | Crowner et al. | 49/360 |
| 6,194,851 | B1 | * | 2/2001 | Denault et al. | 318/139 |
| 6,218,956 | B1 | * | 4/2001 | Davis et al. | 340/5.1 |

* cited by examiner

*Primary Examiner*—Toan Pham
(74) *Attorney, Agent, or Firm*—Fitch, Even, Tabin & Flannery

(57) ABSTRACT

An apparatus for shutting off power to a gate motor is disclosed when the gate to which the gate motor is connected is opened or closed manually. In a preferred embodiment a sensor is activated that immediately shuts off power to the gate motor upon insertion of a crank into a receptacle on a pulley of the power driven gate movement system to commence manual opening or closing of the gate with the crank. Rotation of the crank in the appropriate direction either opens or closes the gate. Power is restored to the gate motor when the sensor determines that the crank has been withdrawn from the pulley.

23 Claims, 5 Drawing Sheets

METHOD AND APPARATUS FOR THE SAFE MANUAL OPERATION OF AN AUTOMATED SECURITY GATE

FIELD OF THE INVENTION

The present invention concerns a safety apparatus and method used in a gate security system to prevent injury to a user of the system. More particularly it relates to a method and apparatus that automatically shuts off power to the gate security system when a user of the system manually opens or closes the gate.

BACKGROUND OF THE INVENTION

Systems that control and limit access to a secure area are very common in our current day and age. They have wide spread use in gated communities, apartment complexes and single-family residences. These security systems consist of enclosing the selected secure area with some type of barrier and limiting access to the secure area to selected entry-exit points where those wishing to enter or leave can be screened to determine if they meet the criteria of those who can have access to the secure area. Typically, the entry-exit points have a movable barrier controlled by a guard or an automated system to allow entry or exit from the secure area.

In systems manned by a guard, upon the arrival at the barrier the person desiring entry will provide some proof to the guard that they are authorized to enter. Upon determining that the individual is authorized to enter the guard will open the gate, generally by pressing a gate open button so the gate motor can open the gate or alternatively when the individual either on foot or in a vehicle approaches the gate a sensor triggers the opening and then subsequent closing of the gate when the individual or vehicle passes into the secure area.

In an automated system without a guard the individual seeking entry will initiate the opening of the gate by a variety of means, these can include use of a transponder that transmits a coded signal to the gate opening mechanism or entering a code on a key pad to initiate opening of the gate. Other automated gate entry systems provide for calling on a communication device provided at the gate to another individual at a different location that has authority to open the gate with some type of remote control device.

Gate entry systems are used in a wide variety of circumstances including systems for allowing individuals or motor vehicles to have ingress or egress to the secure area. However, since all of these systems are automated to one extent or another, including motors to open and close the gate or barrier, they are all subject to malfunction or failure at one time or another. Often the system is located in a remote location. Thus, they have back up mechanisms or other alternative means to assure that the system can still function and allow them to be used even in the event of failure. One of the alternative means provided in many of these gated security systems, in particular those that rely on a motor to open and close the gate, is a mode of manually opening and closing of the gate. One means is to provide some type of release mechanism that detaches the gate from the automated system. Once detached the gate can than slide or swing freely depending on whether it is a sliding or swinging gate. The trouble with this alternative is that once the gate is detached from the system and allowed to swing or slide freely all of the safety and security systems have been overridden. In order to put the systems back on line the gate must be serviced. This typically requires a service call by a technician to assure the gate is properly reconnected to the system.

An alternative that does not require the detaching of the gate from the automated system involves manually opening the gate with the systems gate opening and closing mechanism. This typically involves cranking the gate open or closed by inserting a shaft of a hand or power crank into a crank shaft receptacle located on a pulley or other rotary member used to transfer power from the gate motor to the gate to move the gate. With this alternative the gate operating mechanism remains unaltered and if the problem causing the failure of the system is transitory, i.e. the result of a local power failure, there is no need for a service call to reset the gate mechanism. However, this alternative has a serious problem in that if the automatic system starts to function while the gate is being manually cranked open or closed, such as the gate motor starts, the individual operating the crank might be injured, perhaps seriously or the system itself might be damaged.

Thus, what is needed is a system and method for manually opening and closing a security that does not require detaching the gate form the automated systems but which allows the safe injury free opening and closing of the gate.

SUMMARY

It is an object of the present invention to provide a method and apparatus that will allow an individual to safety manually open or close a security gate that forms part of an automated security gate system. It is another object of the present invention to provide a failsafe safety system that automatically shuts down an automated gate control system while the gate is being manually opened or closed. It is an additional object of the invention to provide a method and apparatus that does not require the system to be reset after it is manually opened or closed. It is yet another object of the present invention to provide a safety system that functions while the gate is being manually opened or closed, that is efficient and easy to manufacture and integrate into new or existing automatic gated security systems.

The invention accomplishes the above and other purposes by providing an automated security gate with a safety mechanism having: a security gate movable between a closed and an open position to thereby deny or allow access to a secure area; a security gate controller which controls the opening and closing of said gate in response to an open or close signal; a motor mechanically connected to said gate which opens or closes said gate upon receipt of an appropriate signal from said gate controller; a mechanism for manually opening and closing the gate when necessary; and a power shut off device which shuts off power to said gate motor when said gate is being manually opened or closed.

In a variation of present invention the power shut off device is a switch response to a crank shaft being inserted in a crank shaft receptacle on the end of the rotating shaft of the motor wherein when the crank shaft is inserted into the receptacle and turned manually opens or closes the gate depending on the direction the crank is turned.

In yet another variation of the present invention the power shut off device is a leaf responsive to a crank shaft being inserted in a crank shaft receptacle on the end of the rotating shaft of the motor wherein when the crank shaft is inserted into the receptacle and turned manually opens or closes said gate depending on the direction the crank is turned, the leaf being retractably pushed out of a path of the crank shaft and thereby engaging a power shut off switch of the motor.

In another aspect of the invention it provides a method for providing a user safe system for manually opening or closing a security gate in which the automatic opening and closing apparatus has malfunctioned including the steps of: manually opening or closing a security gate when it fails to open or close do to a malfunction of the system; shutting of the power to the automatic gate opening system as soon as the step of manually opening or closing the gate commences; and turning the power back on as soon as soon as the step of manually opening or closing the gate ceases.

BRIEF DESCRIPTION OF THE DRAWINGS

The invention will be better understood by an examination of the following description, together with the accompanying drawings, in which:

FIG. 1 depicts a portion of the drive mechanism located in the gate housing depicted in FIG. 1;

FIG. 4 is a schematic block diagram of the invention and some of the function components it would work with;

DETAILED DESCRIPTION OF THE PREFERRED EMBODIMENT

Figure 1:
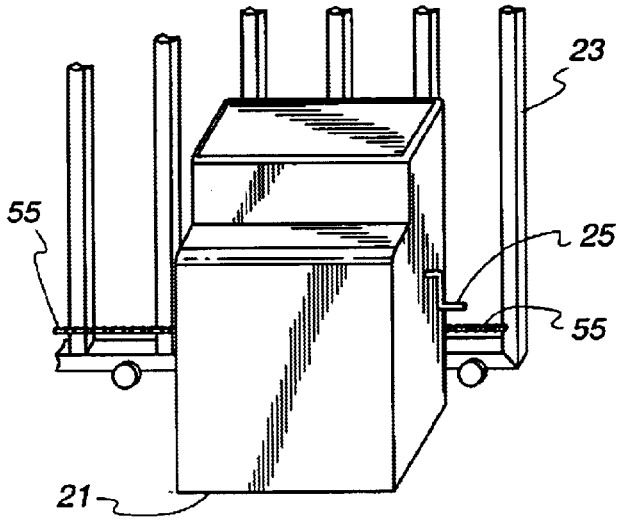
Fig. 1 (Prior Art)
FIG. 1 depicts the housing of a security gate system with a hand crank inserted therein to open an adjacent gate.
Figure 1A:
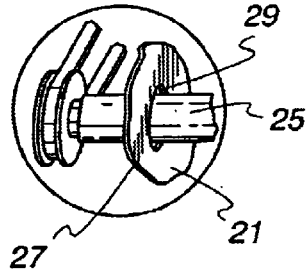
Fig. 1A (Prior Art)
Figure 2:
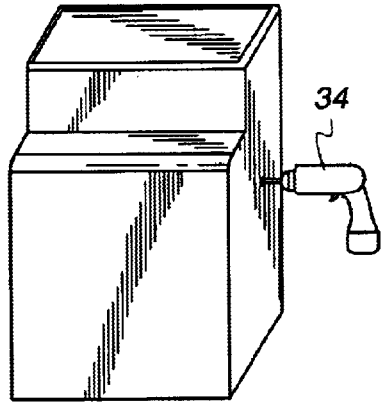
Fig. 2 (Prior Art)
FIG. 2 is another view of the gate housing with a power crank inserted therein to manually open an adjacent gate.

FIG. 1 shows some of the basic parts of a typical security gate system. Enclosure 21 houses the gate motor, gate controller and mechanism for transferring the power of the motor to the gate to thereby move the gate 23. If a failure occurs due to a power failure, malfunctioning of the gate controller which controls the opening or closing of the gate or for some other reason an individual that wants to open or close the gate need only insert a crank 25 into a crank shaft receptacle 26 on the end of drive shaft 39 of motor 36 and crank the gate open or closed. FIG. 1 provides a blow up view of the opening 27 in the housing through the crank is inserted into the crank receptacle 29. Crank 25 is then rotated to open the gate 23. A belt 31, part of which can be seen, forms part of the mechanism for transfer power from the motor 36 to the gate to open the gate. The person using crank 25 thus uses the same mechanical system to open gate 23 as the gate motor 36. FIG. 2 depicts use of a power crank 34 to open the gate.

Figure 3:
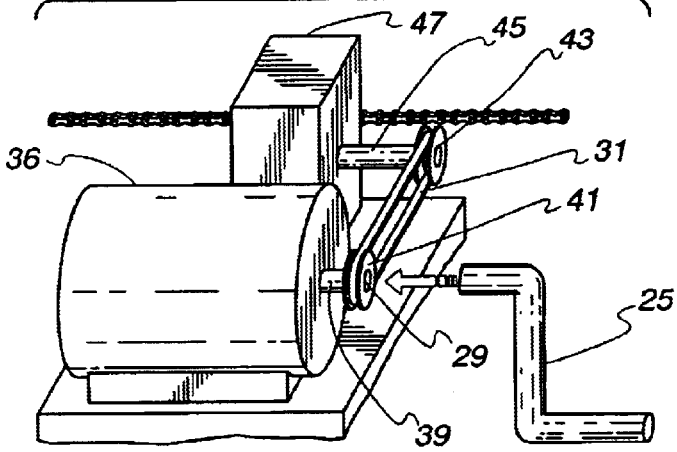
Fig. 3 (Prior Art)
FIG. 3 is a view of a gate motor and part of the drive mechanism Located in the gate housing depicted in FIGS. 1 and 2.
Figure 3A:
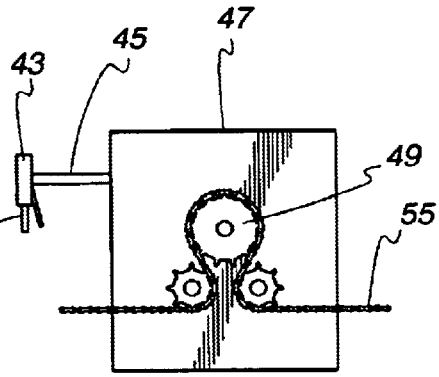
Fig. 3A (Prior Art)
FIG. 3A is a review view of a gear box hosing located within the housing of FIGS. 1 and 2.

FIG. 3 provides a view of gate motor 36, crank 25, and crankshaft receptacle 29 used in current security gate systems with the cover removed. Drive shaft 39 of motor 36 has pulley 41 at its end that transfers power to belt 31. Also, crankshaft receptacle 29 is located on the side of pulley 41 opposite drive shaft 39 of motor 36. Belt 31 transfers power from pulley 39 to pulley 43. Pulley 43 connects to gate drive shaft 45. Gate drive shaft 45 transfers the power to a gear box 47 FIG. 3A, which in turn transfers the power to move the gate. Gear box 47 (FIG. 3A) in turn transfers the power to drive pulley 49. In turn drive pulley 49, in concert with positioning pulleys 51 and 52, moves chain 55 to thus move gate 23 (FIG. 1) back and forth. As noted, the proceeding only describes one system, any number of different types of mechanical systems, not shown, can be used to make the final transfer of power and thus move the gate. The system also has limiting switches or sensors that tell the system when the gate is fully open or closed. The preceding description and drawings only depict one type of security gate set up. Those of ordinary skilled in the art once having read and understood the concepts set forth will readily see that the invention to be disclosed herein has wide application with a variety of security gate systems.

As previously discussed one of the problems with all security gate systems that allow the manual opening or closing of the gate in an emergency is the possibility of injury to the person opening the gate or damage to the mechanism if the security gate system were to start operating when the gate is manually being opened or closed. If a person is manually opening the gate with a crank and the power was to suddenly come on serious injuring could result such as a broken arm or some similar injury. The motor turns at multiple revolutions per seconds much faster than a person might be able to crank it. The person turning the crank would feet a sudden jolt as the motor inadvertently kicks on. If the person opening the gate manually were to be using a power crank 34 (FIG. 2) not only might he or she be injured when it kicks back if the motor were to inadvertently start the system or the power crank could be damaged.

Figure 4:
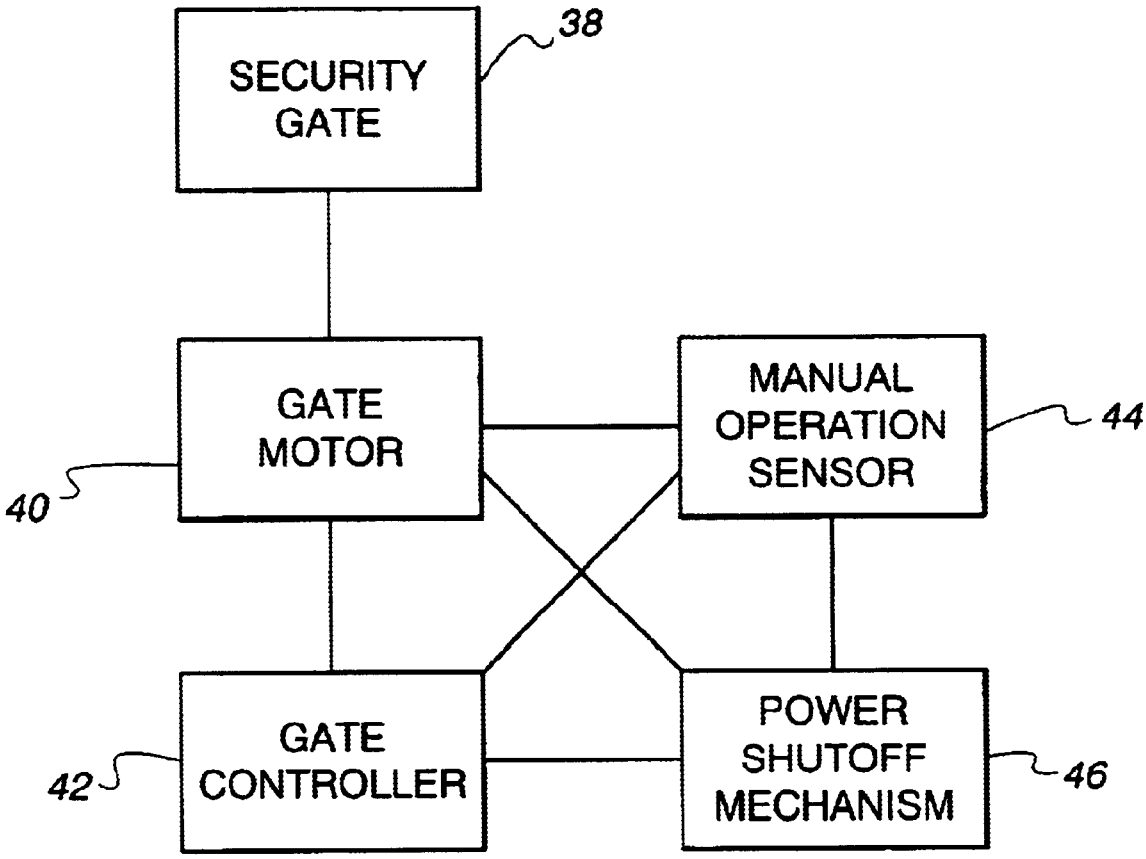

FIG. 4 provides a schematic block type diagram of the major functional components of the invention and the system with which the invention would be used. A security gate 38 operating under normal parameters would be opened and closed by power provided by gate motor 40. Gate controller 42 would control the operation of gate motor 40. The invention herein adds manual "gate" operation sensor 44 and power shut off mechanism 46. The present invention operates such that whenever someone is attempting to open or close gate 38 sensor 44 would note this fact and generate a gate manual operation signal. Power shut off mechanism 46 would receive the gate manual operation signal and accordingly either directly shut off power to gate motor 40 or send a signal to gate controller 42 which in turn would shut off power to motor 40 for so long as the gate manual operation signal was generated by sensor 44. As will be noted in more detail below sensor 44 and power shut off mechanism can be separate entities or a single unity device. In it simplest form sensor 44 and power shut off mechanism 46 would be a single switch activated by the insertion of a crankshaft into a crankshaft receptacle for manually opening or closing gate 38. The single switch would shut off gate motor 40 directly. More sophisticated systems would have a separate sensor 44 and power shut off mechanism 46 as will be explained in more detail below.

The above description only provides a basic description of a security gate system using a preferred embodiment of the present invention. Such systems can be much more sophisticated and include sensors embedded in the roadway leading into and through the gate for detection of vehicles. The gate controller can have many different functional features all controlled by its own computer system with memory with security codes it identifies as belonging to persons or vehicles authorized to enter the restricted area. Many of these features are well known to those of ordinary skill in the art and will not be discussed at length herein since they are not necessary for a complete description of the invention herein and an understanding of the invention herein.

Figure 5:
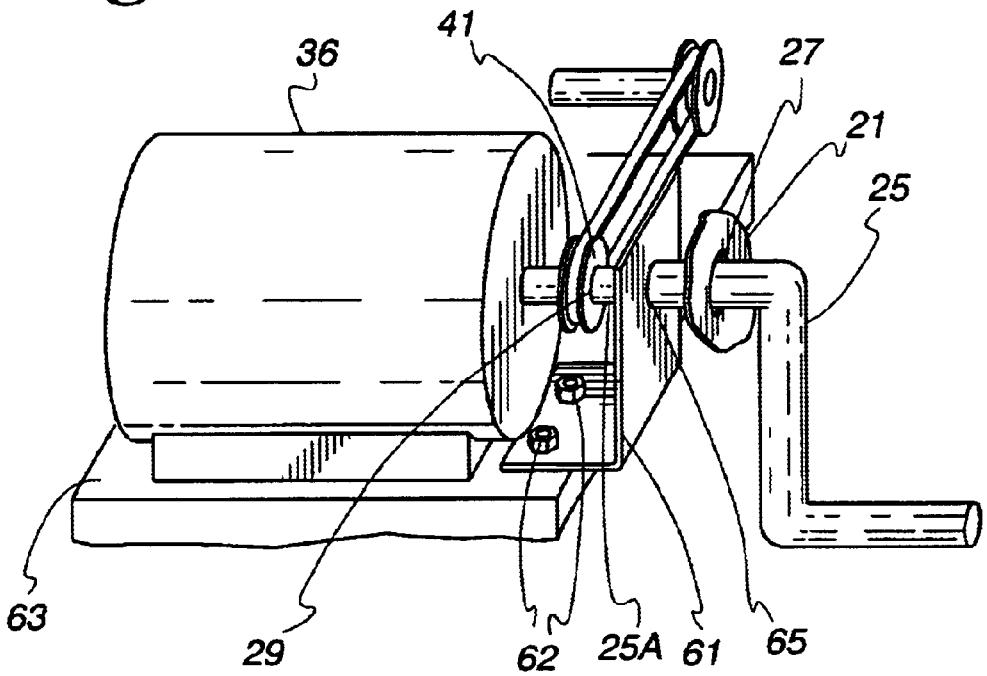
FIG. 5 is a view of the gate motor with the present invention implemented.

FIG. 5 depicts the present invention implemented in the above-described system. A safety plate 61 is positioned between the interior side of the gate system housing 21 (depicted in partial cut away view) and pulley 41. Safety plate 61 in the embodiment depicted attaches by bolts 62 to motor stand 63. Safety plate 61 has an opening 65 positioned at point between crank receptacle 29 and opening 27 in housing 21. Thus, when shaft 25A of crank 25 is inserted into opening 27 on housing 21 to position the end of the crankshaft in the crankshaft receptacle 29 it passes through opening 65 of safety plate 61. When shaft 25A of crank 25 passes through opening 65 it trips or activates a sensing device or switching device that automatically turns off the power to the motor or to the entire gate security system and the power remains off for so Long as the shaft is inserted through opening 65. This thereby prevents the power to the motor from inadvertently coming on when the gate is manually being opened or closed. This type of safety shut off mechanism works automatically without the need of the person opening or closing the gate having to take the extra step of shutting the system power off, a step that one could easily forget. Additionally, it is the least intrusive means for implementing a safety shut off feature since the act of manually opening the gate automatically implements the system but does not otherwise disturb or reset the system. Thus, if the problem is a transient or passing one, such as a Local power failure, once local power is restored there is no need for any further action on the system in order to assure it is properly functioning.

A variety of sensor or switching systems can be used as part of the present invention. They can range from electromechanical switches to infrared or light sensitive sensors such as those activated by the breaking of the path of a beam of light.

Figure 5A:
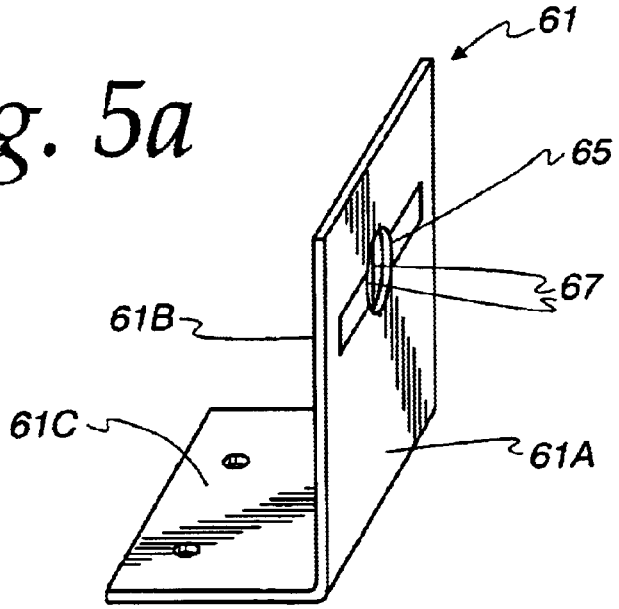
FIG. 5A is a perspective side view of a preferred embodiment of the safety plate.
Figure 6:
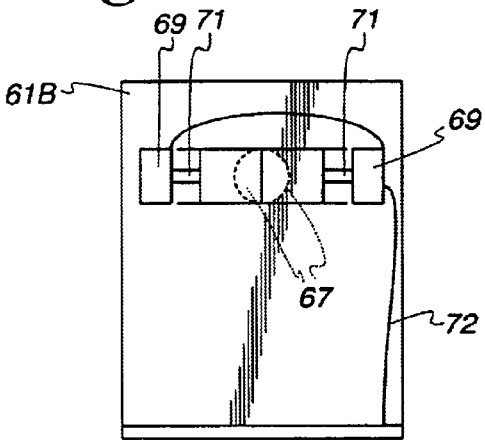
FIG. 6 is a rear view of the safety plate with a first version of the present invention.

FIG. 5A provides a perspective view of safety plate 61 with a first version of the shut off device of the present invention. Plate 61 has a front 61A, a rear or back surface 61B and a base 61C. In FIG. 5A a portion of two sliding doors or leaves 67 cover opening 65. FIG. 6 provides a view of the rear 61B of safety plate 61 on which the mounting of leaves 67 can be view. Upon insertion of the shaft of a crank leaves 67 would slide out and make contact with switches 69. When doors 67 are pushed out they depress buttons 71 on each of the switches. Wire bundle 72 would connect switches 69 to the electrical system of the security gate system. Upon insertion of the shaft of the crank and activation of the switches the power to at least the gate motor is turned off. The power remains off while the shaft of the crank remains in the crank receptacle. Thus, while the crank is being turned to open or close the gate the power remains shut off.

Figure 7:
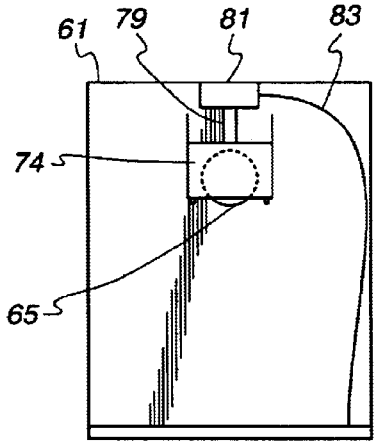
FIG. 7 is a rear view of the safety plate with a second version of the present invention.

Only one switch and leave could be used and the system would still operate properly. As depicted in FIG. 7 a single door or leaf 74 partially covers opening 65. When the shaft of a crank is inserted into opening 65 it forces up leaf 74, which slides up on slides 77. When leaf 74 slides up it depresses button 79 of switch 81. Switch 81 is connected to the electrical system of the security gate system by wire 83. This in effect shuts off the power to the motor and or entire gate security system for so long as the shaft remains inserted in opening 65. When the shaft is removed from opening 65 gravity forces leaf 74 back down. This in turn causes button 79 to extend out of switch 81 caused by insertion of a crankshaft.

Figure 8:
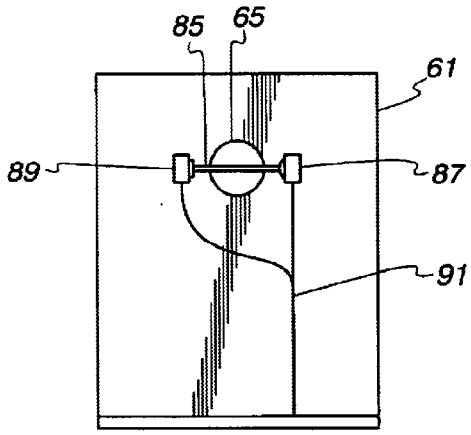
FIG. 8 is a rear view of the safety plate with a third version of the present invention.

FIG. 8 provides another variation of the system in which the shaft of the crank when inserted through opening 65 interrupts passage of a beam of light 85 between a Light source 87 and a light receptor 89. The system detects the interruption of the beam over line 91 and thereby shuts off the power of the system so long as the shaft remains in opening 65 and keeps the power off. Any suitable light source and receptor can be used including a laser light source and receptor.

Figure 9A:
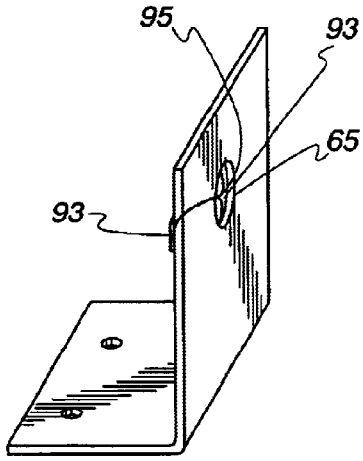
FIG. 9A is a side view of the safety plate with a fourth version of the present invention.
Figure 9B:
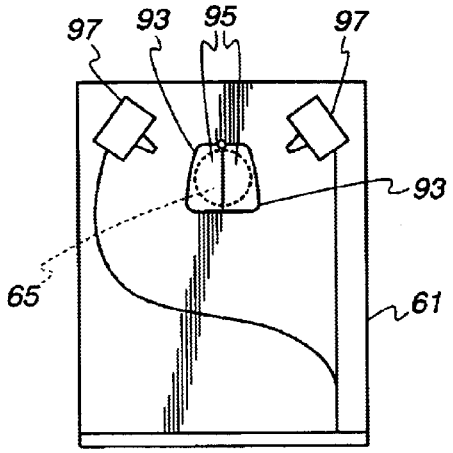
FIG. 9B is a rear view of the safety plate with the leaves of the fourth version of the invention closed over the opening in the plate.
Figure 9C:
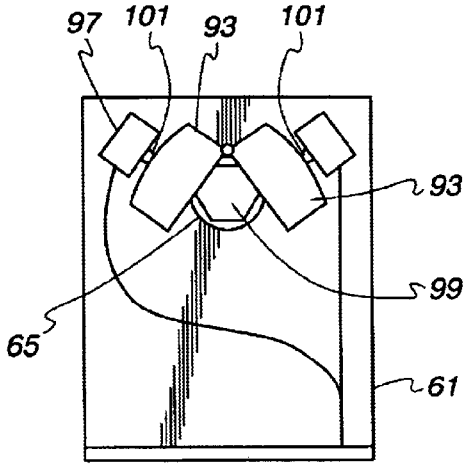
FIG. 9C is a rear view of the safety plate with the Leaves of the fourth version of the invention in the open position and the shaft of a crank protruding through the opening.

FIGS. 9A to 9C depict another variation of the present invention. In FIG. 9A two leaves 93 cover opening 65. The fronts of leaves 93 form a indented or depressed funnel shape 95 to facilitate the parting of the leaves 93 when a shaft is inserted into opening 65. FIG. 9B provides a rear view of safety plate 61 with leaves 93 closed over opening 65 which appears in outline from. Leaves 93 are attached to safety plate 61 each by single hinge 95. Switches 97 are positioned adjacent to leaves 93 within the swing range of leaves 93. As depicted in FIG. 9C when a shaft 99 of a crank is inserted into opening 65 leaves 93 each swing back out of the way and make contact with buttons 101 of each of the switches 97. Switches 97 connect to the electrical system of the security gate system over tines 103 to thereby signal the system to shut down power while shaft 99 remains in opening 65.

Figure 10A:
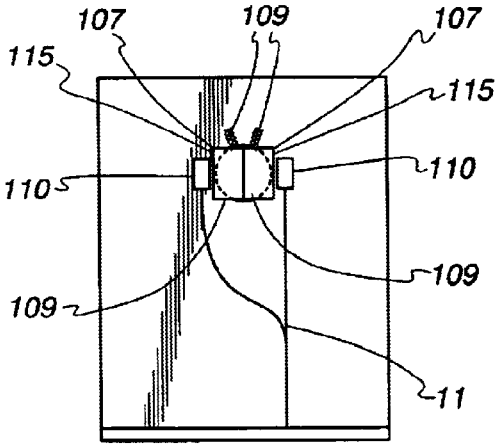
FIG. 10A is a rear view of the safety plate with the leaves of the fifth version of the invention closed over the opening in the plate.
Figure 10B:
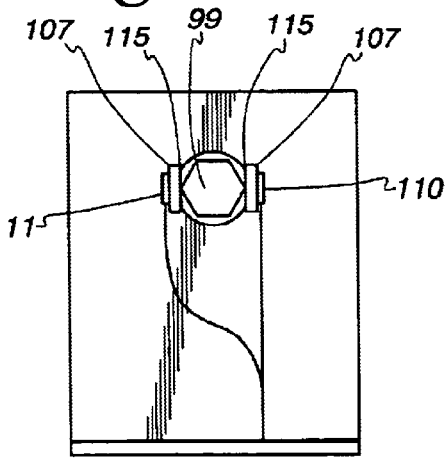
FIG. 10B is a rear view of the safety plate with the leaves of the fifth version of the invention in the open position and the shaft of a crank protruding through the opening.

FIGS. 10A and 10B provide another version of the invention in which two swinging leaves or doors 107 cover opening 65. Leaves 107 are retained in the closed position over opening 65 by springs 109, which pull leaves 107 closed. Adjacent to each of the leaves 107 is contact point or switch 110 which connect to the electrical system of the security gate system by line 112. When a shaft 99 of a crank is inserted into opening 65 this forces leaves 107 back which pivot on hinges 115. As both leaves 107 pivot out they make are forced against contact surface of switch 110. Upon making contact a signal is sent to the electrical system of the security gate system, which initiates a shut off of the power to the gate motor and or system. This shut off condition remains until shaft 99 is removed from opening 65. Device 110 can be either a sensing contact surface or switch for this version of the invention or any of the other versions of the invention. A sensing contact surface While the invention has been particularly shown and described with reference to a preferred embodiment thereof, it will be understood by those skilled in the art that various changes in form and detail may be made to it without departing from the spirit and scope of the invention.

I claim:

1. A security gate with a safety mechanism comprising:

a. a security gate movable between a closed and an open position to thereby deny or allow access to a secure area;

b. a security gate controller which controls the opening and closing of said gate in response to an open or close signal;

c. a motor mechanically connected to said gate which opens or closes said gate upon receipt of an appropriate signal from said gate controller; and d. a mechanism for manually opening and closing said gate when necessary; and e. a power shut off device which shuts off power to said gate motor when said gate is being manually opened or closed.

2. The security gate of claim 1 wherein said mechanism for manually opening and closing said gate comprises a crankshaft receptacle positioned on a rotary part of a mechanical system used to transfer power from said motor to said gate wherein when a shaft of a crank inserted into said receptacle and said crank is rotated said gate is moved between an open and closed position depending on the direction of rotation.

3. The security gate of claim 2 wherein said power shut off device is a switch response to a crank shaft being inserted in a crank shaft receptacle on the end of the rotating shaft of said motor wherein when said crank shaft is inserted into said receptacle and turned manually opens or closes said gate depending on the direction the crank is turned.

4. The security gate of claim 2 wherein said power shut off device is a leaf response to a crank shaft being inserted in a crank shaft receptacle on the end of the rotating shaft of said motor wherein when said crank shaft is inserted into said receptacle and turned manually opens or closes said gate depending on the direction the crank is turned, said leaf being retractably being pushed out of a path of said crank shaft and thereby engaging a power shut off switch of said motor.

5. The security gate of claim 2 wherein said crankshaft receptacle is positioned on a pulley located on a rotary power shaft of said motor.

6. A security gate safety mechanism comprising:

a) a sensor that determines when a security gate, normally opened and closed by an automated system, is being manually opened or closed and generates a manual operation signal for so long as the gate is being manually opened or closed; and b) a power shut off device responsive to said gate manual operation signal from said sensor wherein said shut off device shuts off power to at least a motor used to automatically open or close the gate for so long as said manual operation signal is received.

7. The safety mechanism of claim 6 wherein said sensor and power shut off device is a switch responsive to a crank shaft inserted into a crankshaft receptacle, the receptacle being attached to a mechanical mechanism that manually opens and closes the gate when the receptacle is rotated by the inserted crankshaft.

8. The safety mechanism of claim 7 wherein said switch is movably positioned in a path of the crankshaft when it is inserted into said crankshaft receptacle to thereby sense the presence of the crankshaft.

9. The safety mechanism of claim 8 wherein said switch is movably positioned in the path of the crankshaft when inserted into the crankshaft receptacle by placing a plate in front of said receptacle, said plate having an opening through which said crankshaft must be inserted to be inserted in the receptacle and an activation portion of said switch is displacably positioned over said opening so that when the crankshaft is inserted through the opening it displaces said activation portion which in turn activates said switch.

10. The safety mechanism of claim 9 wherein said activation portion is at least one leaf displacably positioned over said opening.

11. The safety mechanism of claim 10 wherein said leaf is displacably positioned by a spring attached to said leaf which urges said leaf into a position over said opening.

12. The safety mechanism of claim 10 wherein said at least one leaf is displacably positioned over said opening by positioning it such that when the crankshaft is inserted into the opening it urges said at least one leaf in an upward direction in a gravitational field which upon removal of said shaft said gravitational field causes said at least one leaf to fall back across the opening.

13. The safety mechanism of claim 9 wherein said activation portion is a beam of electromagnetic radiation projected across said opening so that when the crankshaft is inserted into said opening it breaks the path said radiation which in turn activates said switch.

14. The safety mechanism of claim 13 wherein said beam of electromagnetic radiation is projected across the opening by means of an electromagnetic generator and received by an electromagnetic receptor and when the path of the beam is broken said receptor actives said switch.

15. The safety mechanism of claim 14 wherein said sensor senses the presence of the crankshaft by being placed on a plate in front of the receptacle, said receptacle having an opening through which the crankshaft must be inserted to be inserted in the receptacle and said sensor senses the insertion of said crankshaft through said opening.

16. The safety mechanism of claim 15 wherein said leaf is retractably positioned over said opening by a spring which it urges it across the opening.

17. The safety mechanism of claim 15 wherein said sensor senses the presence of the shaft in said opening by projecting a beam of electromagnetic radiation across the opening which the shaft breaks when inserted through said opening.

18. The safety mechanism of claim 17 wherein said beam of electromagnetic radiation is projected across the opening by means of an electromagnetic generator and received by an electromagnetic receptor positioned on either side of said opening and when the path of the beam is broken said receptor generates said manual operation signal.

19. The safety mechanism of claim 6 wherein said sensor can sense an insertion of a crankshaft into a crank shaft receptacle, the receptacle being attached to a mechanical mechanism that opens and closes the gate when the receptacle is rotated by the crankshaft, and wherein when said sensor upon sensing the presence of the crank shaft generates a manual gate open-close signal which is received by said power shut off device and wherein said power shut off device shuts off power to the automatic gate opening mechanism.

20. The safety mechanism of claim 19 wherein said sensor senses the presence of the shaft in said opening with at least one retractable leaf placed over said opening which the shaft push the teat out of the way when inserted through said opening and said at least one leaf moves back across said opening when the shaft is removed from the opening.

21. The safety mechanism of claim 20 wherein said leaf is retractably positioned over said opening by positioning it for upward movement in a gravitational field when upon insertion of the shaft and wherein the gravitational field causes it to fall back across the opening when the shaft is removed.

22. A security gate with a safety mechanism comprising:

a) a security gate movable between an open and closed position to thereby permit or deny access to a secure area;

b) a gate movement mechanism and power source for the same to move said gate between said open and closed position;

c) a gate controller to automatically initiate opening and closing of the gate with the gate movement mechanism and power source upon receipt of appropriate authorization to do so;

d) a manual gate movement apparatus that will allow the manual opening and closing of the gate when a failure occurs in the gate controller or power source;

e) a sensor which senses when the manual gate movement apparatus is being used and generates a gate manual movement signal; and f) a gate power shut off device that shuts off power to the gate power source when the gate manual movement signal is received form said sensor.

23. A method for providing a user safe system for manually opening or closing a security gate in which the automatic opening and closing apparatus has malfunctioned comprising the steps of:

a. manually opening or closing a security sate when it fails to open or close do to a malfunction of the system;

b. shutting of the power to the automatic gate opening system as soon as the step of manually opening or closing the gate commences; and c. turning the power back on as soon as soon as the step of manually opening or closing the gate ceases.

* * * * *